US006178673B1

(12) United States Patent
Blackford et al.

(10) Patent No.: US 6,178,673 B1
(45) Date of Patent: Jan. 30, 2001

(54) WIND RESPONSIVE DISPLAY DEVICE

(75) Inventors: Kenneth Blackford; David Rogers, both of Winston-Salem, NC (US)

(73) Assignee: Imageworks Display & Marketing Group, Winston-Salem, NC (US)

( * ) Notice: Under 35 U.S.C. 154(b), the term of this patent shall be extended for 0 days.

(21) Appl. No.: 09/359,719

(22) Filed: Jul. 23, 1999

(51) Int. Cl.[7] ..... G09F 19/00

(52) U.S. Cl. ..... 40/440; 40/406; 40/422; 40/602; 446/236

(58) Field of Search ..... 40/440, 406, 422, 40/124.14, 602; 446/217, 236

(56) References Cited

U.S. PATENT DOCUMENTS

| | | | |
|---|---|---|---|
| D. 270,046 | * | 8/1983 | Burkheimer . |
| D. 373,601 | | 9/1996 | Jackle . |
| 2,375,692 | * | 5/1945 | Rulfs . |
| 3,292,569 | * | 12/1966 | Trigilio . |
| 3,596,380 | * | 8/1971 | Williams . |
| 3,638,341 | * | 2/1972 | Holmes . |
| 4,248,001 | * | 2/1981 | Feuvray . |
| 4,353,179 | | 10/1982 | Jennings . |
| 4,658,527 | | 4/1987 | Pingel . |
| 5,196,961 | | 3/1993 | Sun . |
| 5,307,580 | | 5/1994 | Farmer . |
| 5,360,363 | * | 11/1994 | Levin . |
| 5,566,483 | | 10/1996 | Ogren . |
| 5,606,815 | | 3/1997 | Feldwhere . |
| 5,862,619 | * | 1/1999 | Stancil . |

* cited by examiner

*Primary Examiner*—Terry Lee Melius
*Assistant Examiner*—William L. Miller

(57) ABSTRACT

A wind responsive sign or placard for displaying advertising or other visual indicia includes a rotatable member that is attached to a stationary mounting member by a rod extending between the two members. Both the rotatable or spinning member and the stationary mounting member are formed of fluted or corrugated panels, and the axle rod extends into aligned flutes or channels in the two principal components. These panels are fabricated from extruded plastic panels of the type suitable for exterior use. The panel forming the mounting member is folded to form a three dimensional structure that is more rigid than the flat rotatable panel. The sign formed in this manner is relatively light in weight and can be assembled on site and can be mounted to a pole or post in an elevated position.

19 Claims, 11 Drawing Sheets

WIND RESPONSIVE DISPLAY DEVICE

BACKGROUND OF THE INVENTION

1. Field of the Invention

This invention is related to signs, signboards, placards, displays or posters that are used to convey informational or advertising messages and are used to display visual indicia of a promotional or informational nature. More particularly this invention is related to an exterior sign or placard that includes a movable component for attracting attention to the visual message located on the movable component as it is driven by exterior wind currents. This invention is also related to signs that are lightweight and portable and can be easily assembled on site an mounted at elevated locations on posts, poles or other surfaces.

2. Description of the Prior Art

Fluted or corrugated thermoplastic signs or signboards are commonly employed for advertising displays in exterior locations. These signs are typically fabricated from die cut panels that can be extruded. These panels have opposite planar exterior faces with internal transverse webs extending between the two spaced apart faces on which advertising, informational or other visual indicia can be screen printed or otherwise applied. The transverse webs provide rigidity to the panel in much the same way that corrugations impart rigidity to cardboard panels. However, the plastic material is more impervious to moisture and other environmental contaminants, and are therefore more suitable for exterior locations. Since the cross section of these fluted or corrugated plastic members does not change longitudinally, these panels can be inexpensively extruded from a thermoplastic. Examples of commercially available extruded thermoplastic fluted or corrugated panels of this type are those manufactured and sold using the trademarks COROPLAST® or POLYFLUTE® by Coroplast Inc., and those manufactured and sold using the trademark COR-X® by Primex Plastics Corp. Panels or sheets of this general type can be made of polypropylene, ABS, clear polyester, or other suitable thermoplastics.

Perhaps the most common use of fluted or corrugated panels or sheets of this type for exterior signs are the simple signs that include a single flat panel with stakes extending into the flutes or channels to support the signs in the ground. Signs of this type are commonly used for on site real estate advertisements. One example of a sign of this type is shown in U.S. Pat. No. 4,658,527. Although inexpensive extruded corrugated or fluted plastic panels are especially useful for such applications, other similar signs can be fabricated from sheet metal as shown in U.S. Pat. No. 5,307,580. Cardboard could also be employed in similar applications, although its inferior environmental resistance would limit the useful life of cardboard or corrugated paperboard signs of this type.

Although stationary flat panel signs of this type are suitable for certain applications, they do not provide any means for attracting an observer's attention to the message displayed on the sign. One means for drawing attention to an advertising message is to impart movement to a portion of the sign. A wind-actuating rotating disk is used in U.S. Pat. No. 5,196,961 and a wind actuated rotating sign is shown in US Design Patent 373,601. Each of these devices appear to be manufactured of sheet metal or to impart sufficient rigidity. The design shown in the latter patent also appears to be mounted on brackets fabricated from tubing having a rectangular cross section which must be crimped at its bend lines.

Another approach to a wind driven rotating sign is disclosed in U.S. Pat. No. 4,353,179, which shows a three sided sign with vertical panels mounted on a shaft extending upwardly from a flat base. The three panels are plastic and are joined together with a suitable adhesive. Portions of each panel extend outwardly form the juncture with an adjacent panel to form a vane that will cause the structure to rotate or turn in a breeze. The three panels are also joined to a top panel that has a dome enclosure in which the top of the shaft resides to support the panel structure while permitting the panels to turn in response to wind currents striking the protruding vanes.

None of these prior art rotating or wind driven signs appear to employ corrugated or fluted panels. Thus these prior art devices do not employ the corrugated or fluted construction of the panels to both provide rigidity and to mount a rotating panel on a stationary support. These prior art wind driven signs also do not appear to take advantage of the relatively light weight of these panels to simplify on site assembly of a wind driven sign. Furthermore none of these prior art movable signs appear to provide a lightweight placard or sign that can be relatively easily mounted at an elevated location on a pole or post where it is more easily observable and more likely to catch a suitable breeze or wind current to impart movement to the sign and to draw a passerby's attention to the message displayed on the sign. The instant invention overcomes each of these shortcomings of the prior art to provide a lightweight, inexpensive wind responsive display that can be easily assembled on site from flat panels and can be mounted in elevated or hard to reach locations. Furthermore the components of the invention described herein can be economically fabricated by die cutting a single panel. The sign can also be mounted either in a vertical orientation to a pole or other surface located on the side of the sign. Alternatively the sign can be mounted on a horizontal surface with a stationary mounting portion located below a movable member attached to it.

SUMMARY OF THE INVENTION

According to one aspect of this invention, a sign would include a spinning member secured to a mounting member by an axle or other means of permitting mutual rotation between the two members. The axle means is attached to the mounting member adjacent one end thereof and the axle is attached to the spinning member along an axis of rotation of the spinning member. The mounting member includes two diverging sides, for imparting rigidity, with aligned recesses in the two diverging sides configured to provide clearance for the spinning member.

According to another aspect of this invention, a lightweight display that can be mounted on a surface includes a turning member secured to a mounting member by at least one axle extending between the mounting member and the turning member. Both the mounting member and the turning member are formed by fluted or corrugated panels. The axle is positioned in aligned flutes in the mounting member and the turning member, so that the turning member is free to move in response to wind currents relative to the mounting member.

This invention also can comprise a placard for displaying visual indicia. This placard has a first panel and a second panel. The second panel is cut from an opening in the first panel. The first panel is folded to form a three dimensional support member for the second panel with a portion of the opening being located along one side of the three dimensional support member. The second panel is supported partially in the portion of the opening on one side of the support member by at least one rod extending between the support member and the second panel.

DETAILED DESCRIPTION OF THE PREFERRED EMBODIMENT

Figure 1:
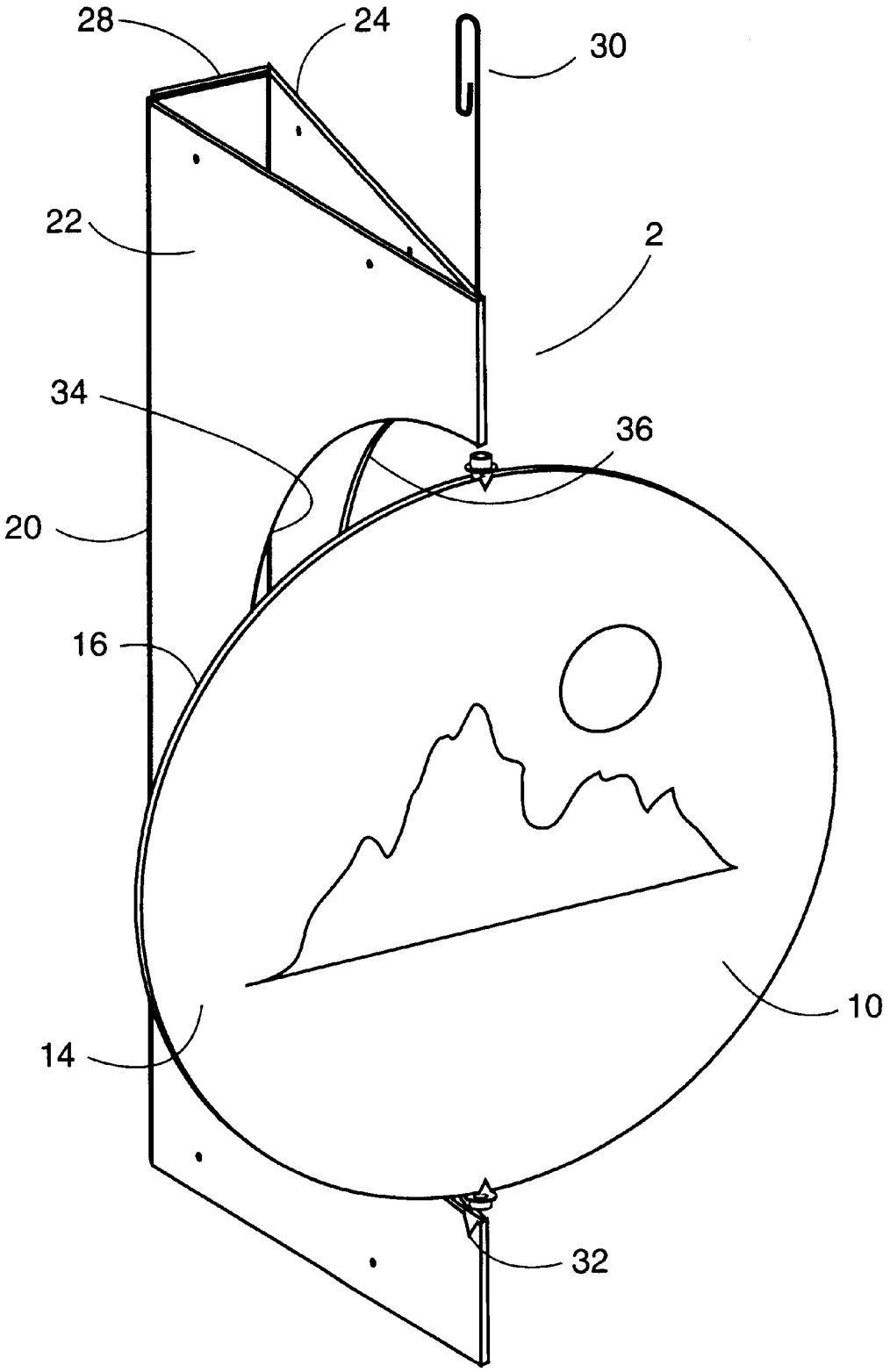
FIG. 1 is a front three dimensional view of the assembled sign, display device or placard showing a turning or spinning disk secured to a support member by an axle rod.
Figure 2:
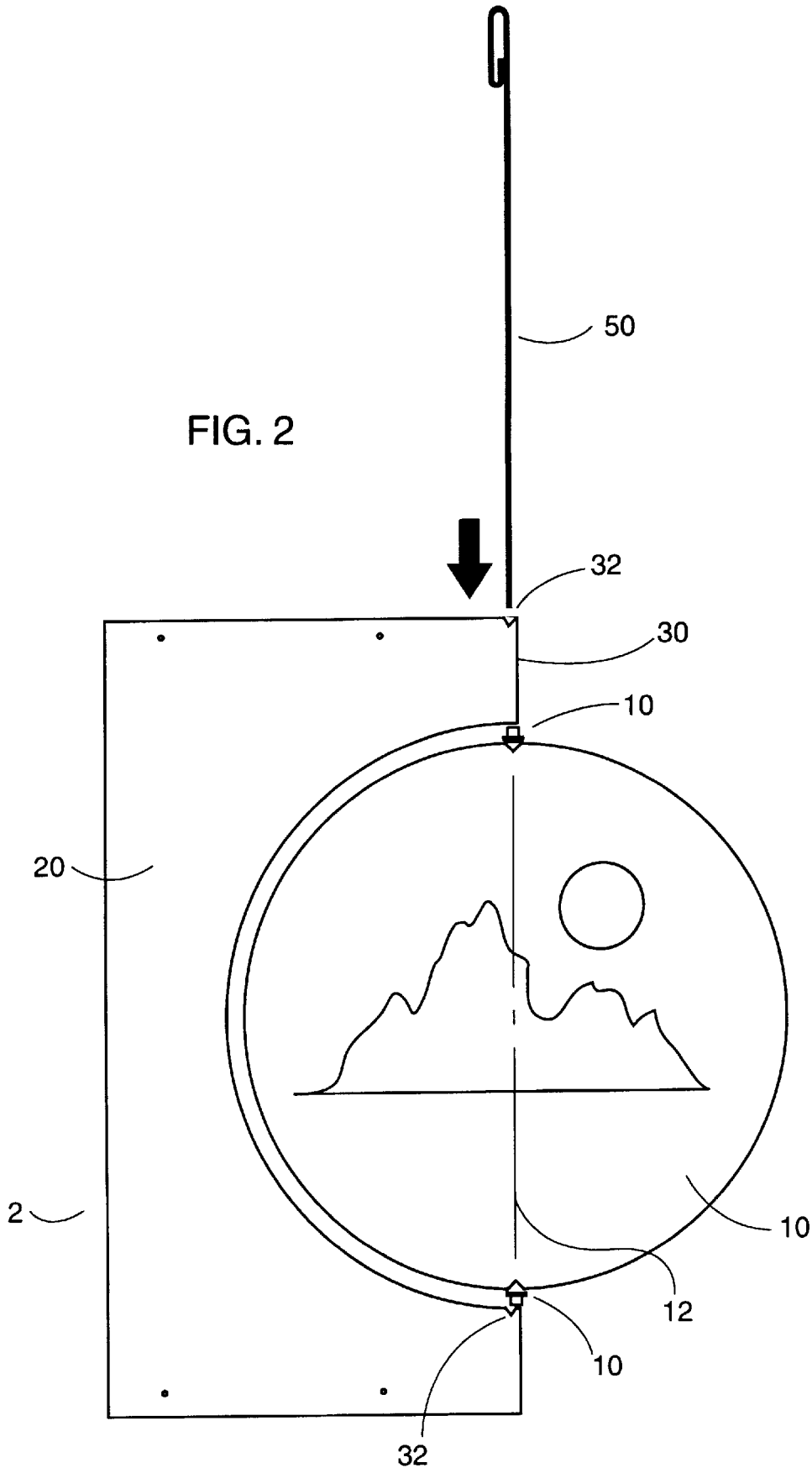
FIG. 2 is a side view of the sign, display device or placard showing the spinning disk oriented to face to the side in a position in which the disk bisects the angle between two diverging sides of the triangular mounting member.

The preferred, representative embodiment of the invention disclosed herein comprises a wind responsive or wind driven sign, display, placard, signboard or other advertising or informational display 2 that can be mounted at an elevated location on a pole or post 4 or on some other surface. The sign 2 includes a turning or spinning component or member 10 that is mounted on a support or base 20 that provides rigidity to the sign 2. In the preferred embodiment, the mounting member 20 is more rigid than the spinning member 10 because of its three dimensional configuration. Both the spinning member 10 and the mounting member 20 are fabricated from fluted or corrugated panels. This panels are preferably fabricated from materials such a extruded thermoplastic sheets. Examples of commercially available extruded thermoplastic fluted or corrugated panels of this type are those manufactured and sold using the trademarks COROPLAST® or POLYFLUTE® by Coroplast Inc., and those manufactured and sold using the trademark COR-X® by Primex Plastics Corp. Panels or sheets of this general type can be made of polypropylene, ABS, clear polyester, or other suitable thermoplastics. Although these plastic materials offer distinct advantages, such as light weight and relatively slight degradation when subjected to an exterior environment and to moisture, other materials can be employed in the broader aspects of this invention. For example, corrugated cardboard or paperboard could be used in some applications, and thicker panels with separate mounting channels or passages could also be employed, especially when it is not necessary to mount the sign at an elevated or relatively inaccessible location. Fluted or corrugated plastic panels, however, permit on site assembly of signs that are light enough and rigid enough to mounted at an elevated position while being large enough to provide a suitable and easily discemable display.

In the representative embodiment depicted in FIGS. 1–5, 10, and 13, the wind responsive or wind driven movable, spinning, turning, rotating, oscillating or gyrating member 10 comprises a flat disk which is free to spin or turn about its axis of rotation 12 which extends diametrically between opposite points on the disk. This flat disk 10 has two opposite exposed display surfaces 14, 16 on which an image, design, text, message, advertisement or other generic visual indicia 18 is located. When fabricated from an extruded, die cut fluted or corrugated sheet or panel, the spinning member or disk 10 has sufficient rigidity to withstand wind currents and is sufficiently light in weight so that it can turn or move in a modest wind to attach attention to the a visual display that can be screen printed on the two exterior surfaces 14, 16. Although in the preferred embodiment the spinning member 10 is a flat disk or circular panel, it should be understood that other shapes could be employed. For example, a two dimensional rectangular shape representative of a beverage can could also be employed. Indeed, the spinning member could be a three dimensional representation of a beverage container or some other item could also be mounted to spin or rotate in substantially the same manner.

The spinning disk or member 10 is mounted on a mounting or support member 20 by an axle rod 50 that is preferably inserted into aligned flutes or passages in both the spinning member 10 and the mounting member 20. Mounting member 20 is a three dimensional member formed by folding an initially flat panel parallel to the longitudinally extending flutes or channels in the fluted or corrugated panel. In the preferred embodiment, the mounting member 20 has a triangular cross section with three sides 22, 24 and 26 which extend vertically when the mounting member 20 is attached to a pole, post or stanchion 4. The first side 22 is joined to the second side 24 along a fold 30 and the first and second sides diverge form their juncture at the fold 30. Semicircular recesses 34 and 36 in the first and second sides 22, 24 respectively, extend from their maximum diameter at the fold 30 to provide clearance for the spinning disk 10 attached to the mounting member 20. Of course, if a noncircular spinning member were employed, the recesses 34 and 36 could be suitably configured to permit the spinning member to rotate in wind currents without interference.

Figure 6:
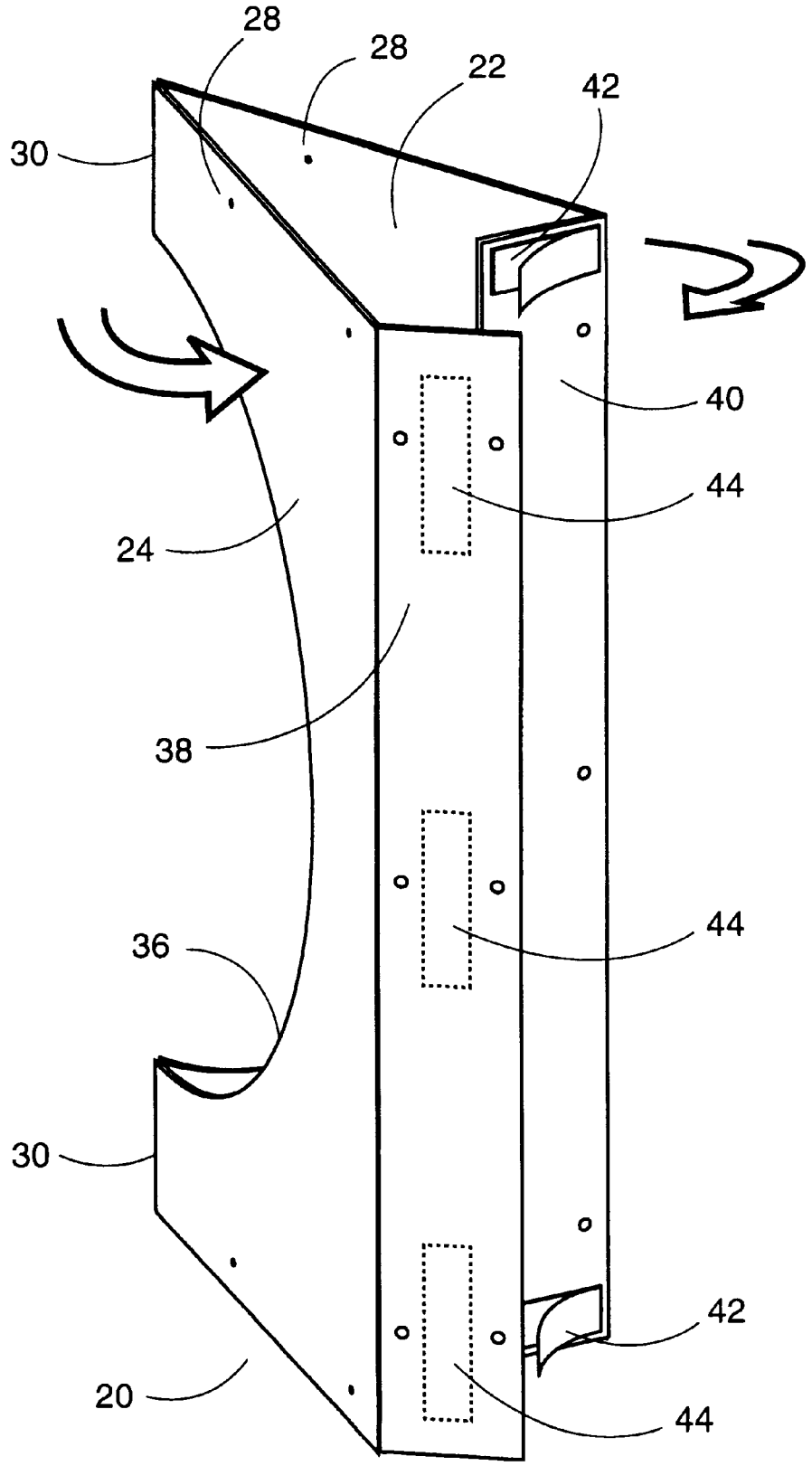
FIG. 6 shows the manner in which an initially flat panel is folded to form the mounting or support member for the rotatable member with display or informational indicia located on opposite surfaces.
Figure 7:
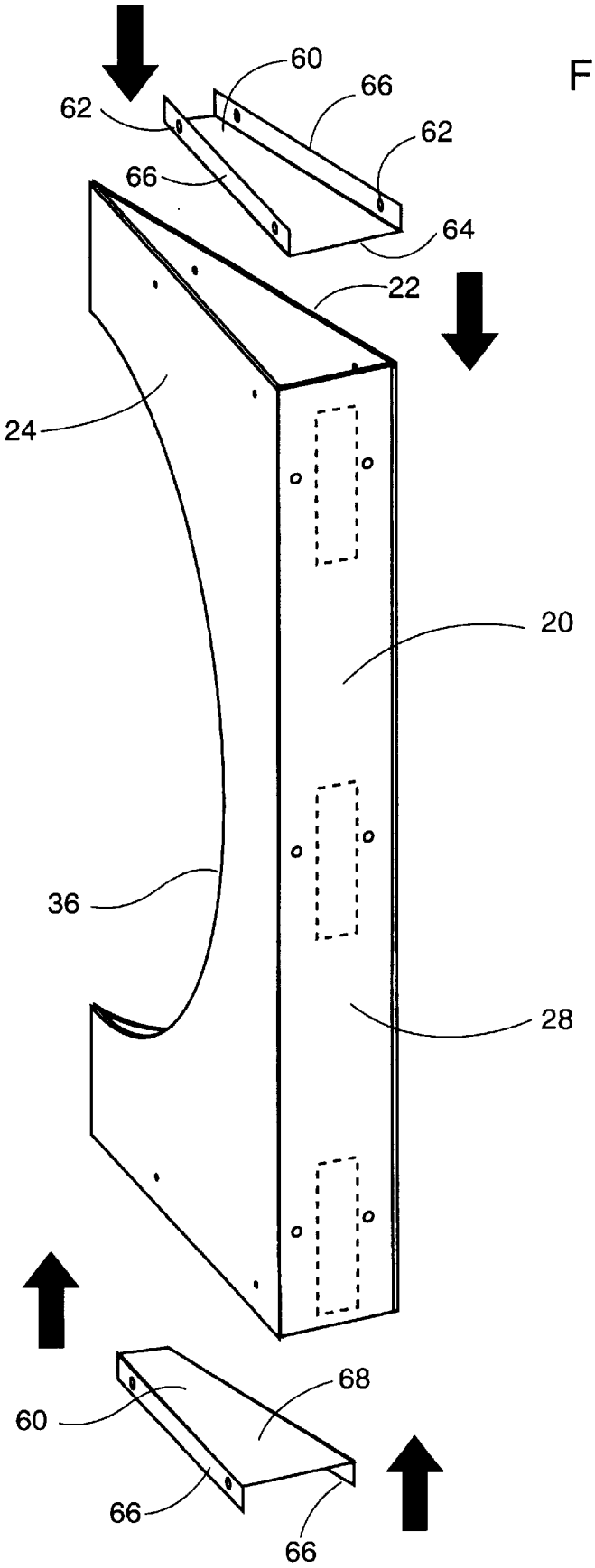
FIG. 7 shows the manner in which upper and lower spacers are secured to the folded panels forming the mounting member to impart rigidity to the mounting member.

The third side 26 of the mounting member 20 is formed by first and second overlapping sections or flaps 38 and 40 as shown most clearly in FIG. 6. Interior adhesive strips 42 located at the top and bottom of the inner overlapping flap 40 secure the outer overlapping flap 38 at the top and bottom of the third side 26. The adhesive strips 42 would normally include peel away strips that would be removed during on site assembly to expose the adhesive. Similar adhesive strips 44 are located on the exterior of the outer flap 38 where they can be used to temporarily attach the mounting member 20 to a pole 4 or other surface. A series of prepunched holes are also provided in the flaps 38, 40 forming the third side 26 so that straps or ties 46 for permanently securing the mounting member 20 to a pole 4 or other surface can be threaded through the third side 26.

After the flaps 38 and 40 have been secured together to form the third side 26 of mounting member 20, spacers or internal supports 60 are inserted into the top and bottom of the mounting member 20. The spacers 60 have sides 66 extending from a base 68. The base 68 is tapered so that the spacers 60 can be inserted between the first and second sides 22, 24 of the supporting member 20. Prepunched holes 62 in the spacers 60 can then be aligned with similar holes 28 on the first and second sides 22, 24. Standard plastic fastening posts, which can be referred to as "Christmas trees" can then be inserted into the aligned holes 28, 62 to secure the spacers 60 between the first and second sides 22, 24 to impart increased rigidity to the three dimensional supporting member 20. Other conventional fastening means could also be employed. In the preferred embodiment, fluted or corrugated panel are used to form the spacers 60, although other materials could be employed. For example, the spacers could be fabricated as tapered block of foam material. Although the preferred embodiment of support member 20 is triangular in cross section, the invention is not limited to the configuration of the representative embodiment depicted herein. For example, the support member 20 could be rectangular in cross section, and the support member need not have a constant cross section between the top and the bottom of the support.

The spinning member 10 is attached to the mounting member 20 by an axle rod 50 that is inserted through aligned flutes or passages in the spinning panel 10 and the mounting member 20. This preferably metal rod 50 is not inserted through the channel or flute that is located at the fold line 30 because that flute or channel will be at least partially collapsed when the first side 22 is folded relative to the second side 24. The rod 50 can however be inserted into the next adjacent flute or channel in the mounting member 20 and into the central or longest flute or channel extending along the axis of rotation of the spinning member 10. These flutes, passages or channel on the two members 10 and 20 are preferably marked by prepunched notches 32 or similar means to identify the proper flute into which the rod 50 is to be inserted. The mounting member 20 could also be prefolded at the proper location for the fold line 30 and at the intersection with the first and second flaps 38, 40 with the other ends of the first and second sides 22, 24.

Figure 8:
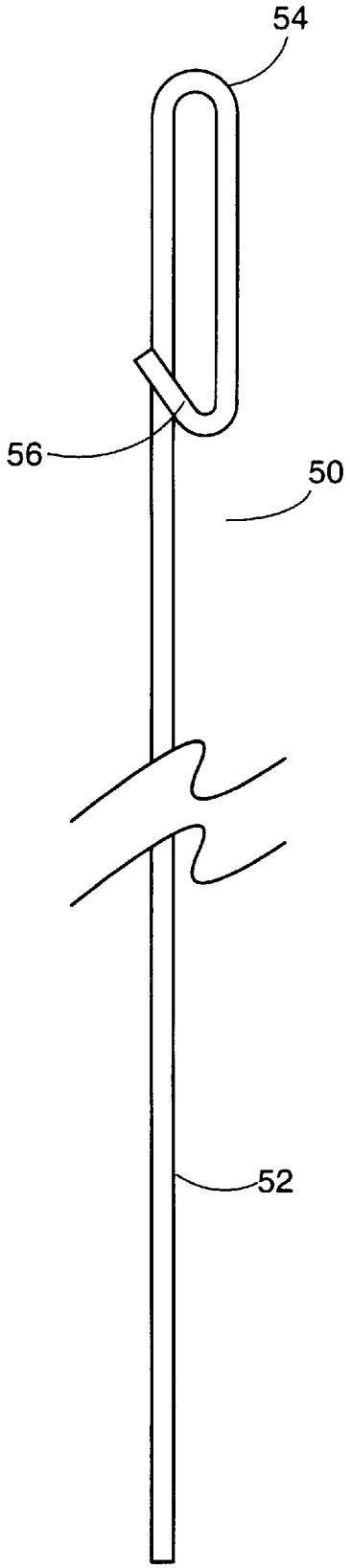
FIG. 8 is a view of the axle rod used to attach the spinning member to the mounting member.

The axle rod 50 is shown in more detail in FIG. 8 where a section of the rod has been removed for illustration purposes. In the preferred embodiment, the rod 50 is a one piece 11 GA. Galvanized steel rod having a length of approximately thirty (30) inches. A straight rod section 52 extends along substantially the entire length of the rod 50 and terminates at the bottom end as shown in FIG. 8. A hood section 54 is formed by reversely bending the top of the rod and a clasp section 56 which overlaps the main rod section 52 is formed at the top end of the axle rod 50. The hook 54 and the clasp 56 secure the axle rod to the top of one of the side panels of the mounting member 20 in one of the prepunched notches 32. I t should be understood that the axle about which the spinning member 10 freely rotates could be formed by equivalent means such as a plastic rod that could be inserted through both the spinning member 10 and the mounting member 20, or separate, shorter rods could be used at opposite ends of the spinning member 10.

Figure 9:
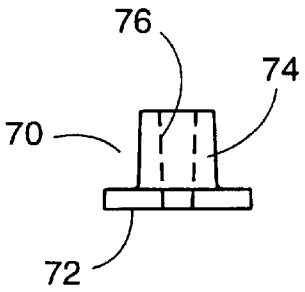
FIG. 9 is a view of a bearing or bushing or top hat spacer that surrounds the axle and is located between the spinning member and the mounting member so that the spinning disk can ride on the bearing and rotate or oscillate relative to the axle and the mounting member.

In addition to the axle rod 50, bearings, bushings or top hat spacers 70 are located between the spinning disk 10 and the mounting member 20 at the top and bottom of the spinning member. These bearings 70 permit the spinning member 10 to rotate or move freely with respect to the stationary support member 20 and the stationary rod 50. These bearings can be molded from a polypropylene or polyethylene or similar material. As seen in FIG. 9, each bearing includes a circular base 72 with a shaft 74 extending therefrom. A conical bearing bore 76 extends through both the base 72 and the shaft 74. Both the rod 50 and the bearings 70 can be assembled between the spinning member 10 and the mounting member on the site where the display or sign 2 is to be mounted or in some other location.

The combination of an axle rod 50 and bearings 70 are not the only means of mounting a rotating or spinning member 10 on a stationary mounting member 20. Other equivalent structures could be employed to permit this mutual rotation. For example a combination of two, mutually rotating interfitting members could be employed. One interfitting member could have a circular rim with a "Christmas tree" style fastener extending upwardly from the center. A second interfitting member could include three snap fingers which engage the rim on the other member so that the three fingers can rotate on the circular rim of its companion member. Two "Christmas tree" style fasteners could extend from opposite edges. These "Christmas tree" style fasteners could be inserted into the flutes or channels of the rotating and stationary members. Interfitting members could be mounted on opposite ends of the spinning member and the mounting member. This is just an example of one of the alternate means equivalent to a solid axle for permitting mutual rotation between the two member. Another equivalent approach would be to use a wire instead of a rigid rod as an axle.

Figure 10:
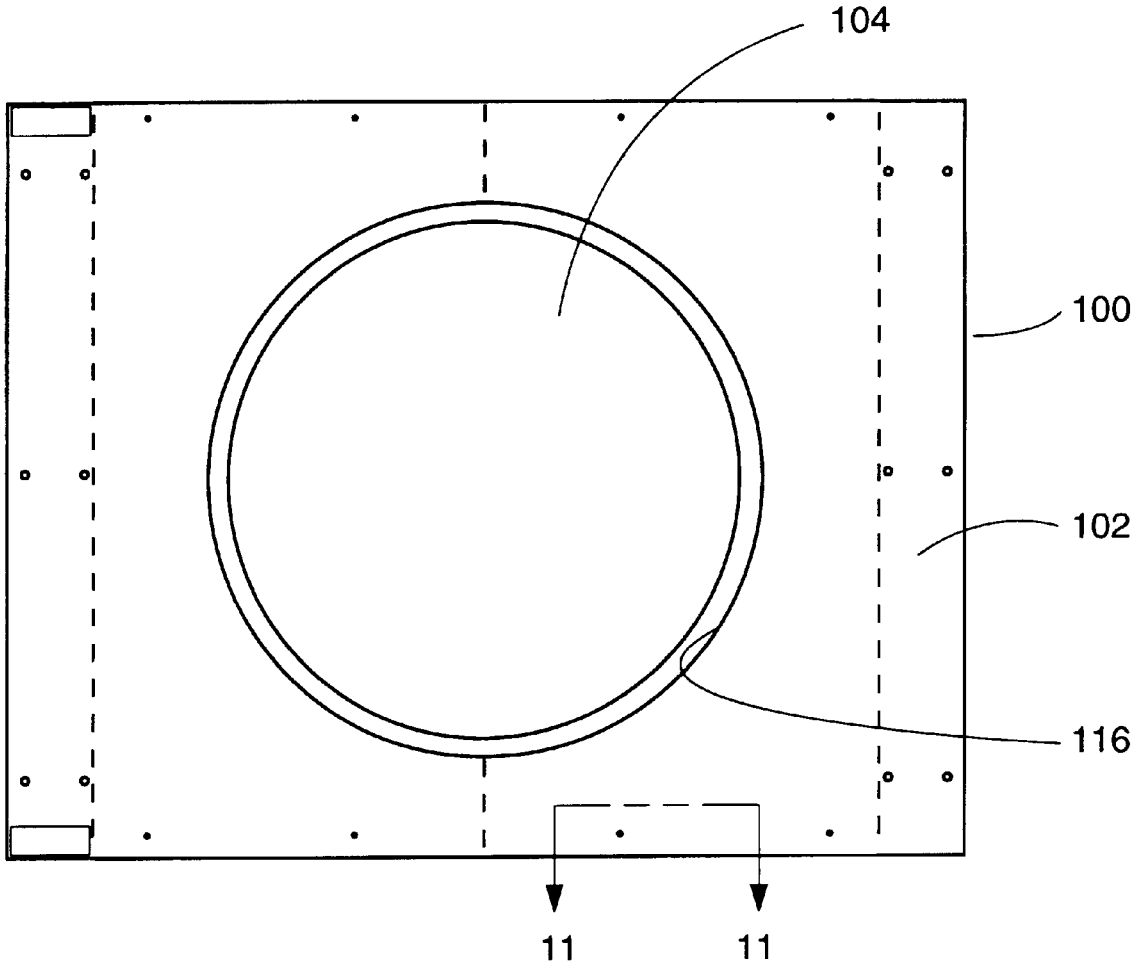
FIG. 10 is a view of the flat blank from which the two panels forming the spinning member and the supporting member are die cut.
Figure 11:
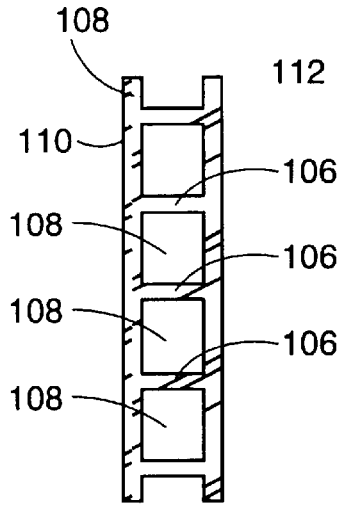
FIG. 11 is a view along the section lines 11—11 showing the extruded fluted construction of the flat panel.
Figure 12:
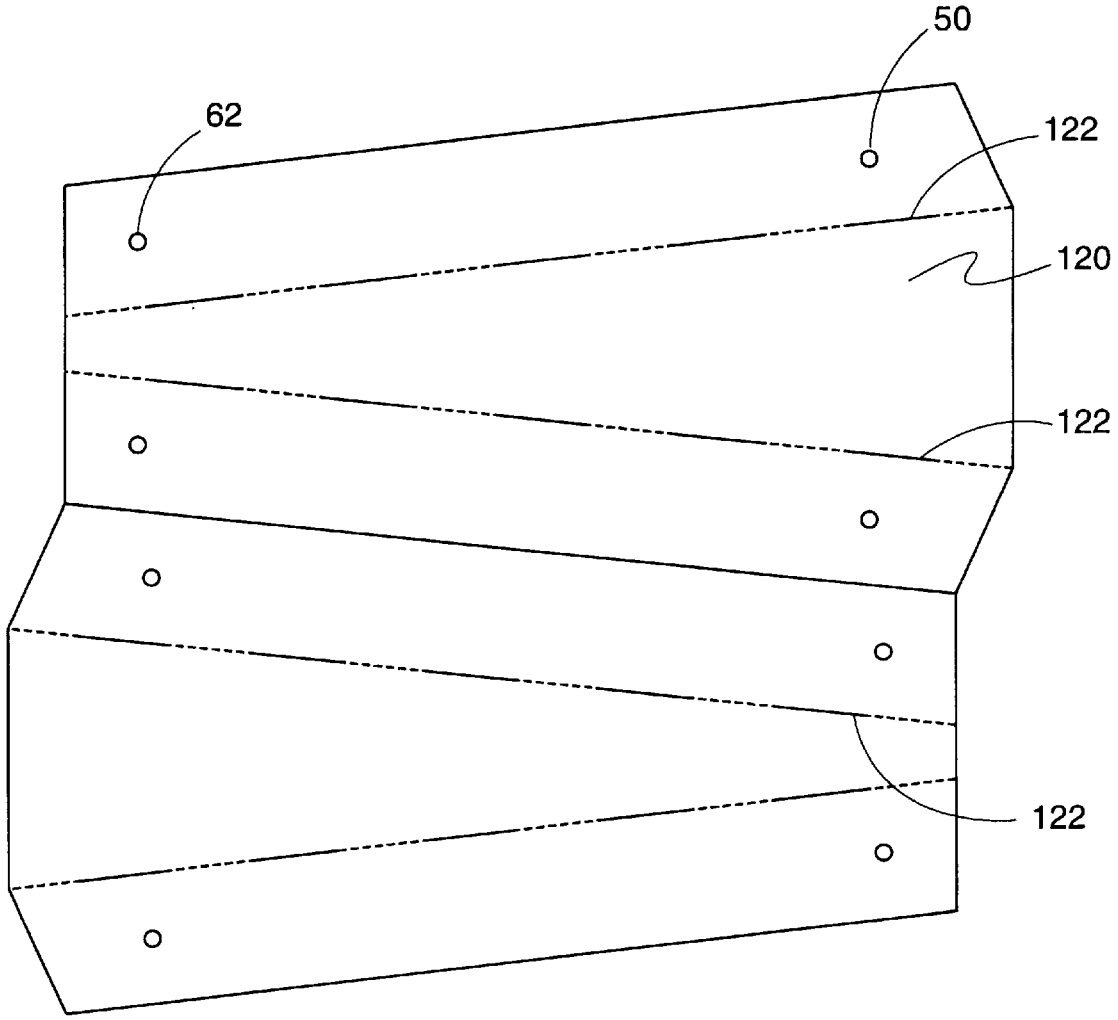
FIG. 12 is a view of a blank from which the upper and lower mounting member spacers are formed.

FIGS. 10 through 12 show a preferred method for fabricating the spinning member 10 and the stationary mounting member 20 as well as the spacers 60. FIG. 1 shows a flat fluted or corrugated panel 100 from which both a circular spinner 10 and a triangular mounting member 20 can be fabricated. The mounting member 20 is fabricated from a first panel section 102 which extends around the periphery of a second circular panel 104. The center second panel 104 is die cut from the flat panel blank 100 to form a circular opening 116. This circular opening forms the two semicircular recesses 34, 36 when the first flat panel 102 is folded along fold line 30 to form the triangular three dimensional configuration of support member 20. By fabricating the two panels in this manner, little material is wasted.

The fluted or corrugated configuration of the panel 100, and therefore of the spinning member 10 and mounting member 20, is shown in FIG. 11, which is a cross section of a portion of the panel 100. This extruded panel has two spaced apart faces, front face 110 and rear face 112. Transverse webs 106 extend between the front face 110 and the rear face 112 on the interior of the fluted panel. The exterior faces 110 and 112 and the transverse webs 106 form a series of parallel flutes, channels or passages 108 which extend between opposite ends of the panel 100. It is these flutes 108 that permit the support panel 102 to be folded to form a three dimensional member and provide for mounting an axle rod 50 to attach the spinning member 10 to the mounting member 20.

FIG. 12 shows the a blank 120 from which a spacer 60 could be formed. Fold lines 122 would be prebent and holes 62 can be punched in the panel. The flat panel 120 is then folded along fold lines 122 to form the spacer configuration.

Figure 13:
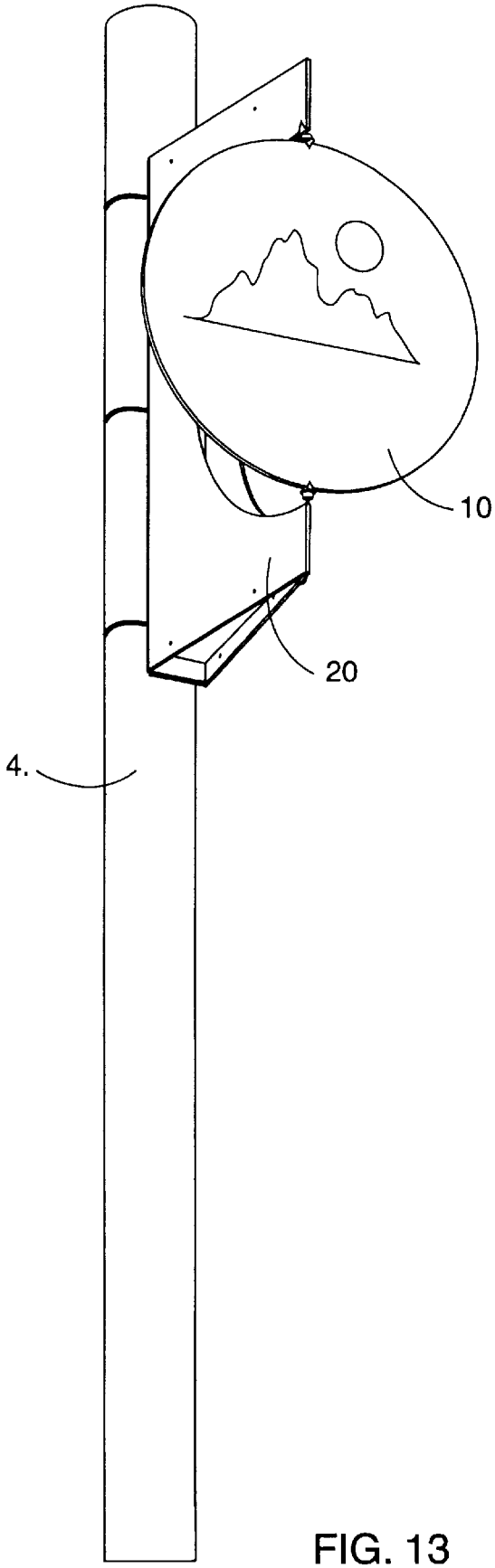
FIG. 13 is a view of a sign in accordance with the instant invention mounted at an elevated location on a light pole of the type that is used to illuminate parking areas or streets.

FIG. 13 shows the manner in which a sign 2 can be mounted on a conventional light pole 4 of the type typically used to light parking areas or streets. The sign can be easily mounted on a pole of this type by using standard straps or ties 46 of the type shown in FIG. 4 and 5. If the diameter of the pole is too large for a single tie 46, two ties can be attached together to secure the mounting member 20 to the pole 4. FIG. 13 shows that the sign or placard 2 can be mounted at a relatively high location because of the light weight of the material form which it is fabricated. The height of this sign could be approximately thirty (30) inches. The diameter of the spinning disk 10 that could be used in this sign could be over twenty (20) inches providing adequate space for the visual indicia 18 that would convey the message to be communicated by the sign 2. This permits the sign 2 to be located at a height where the view is unobstructed and where the sign is exposed to wind currents that rotate or oscillate the spinning member 10.

Figure 3:
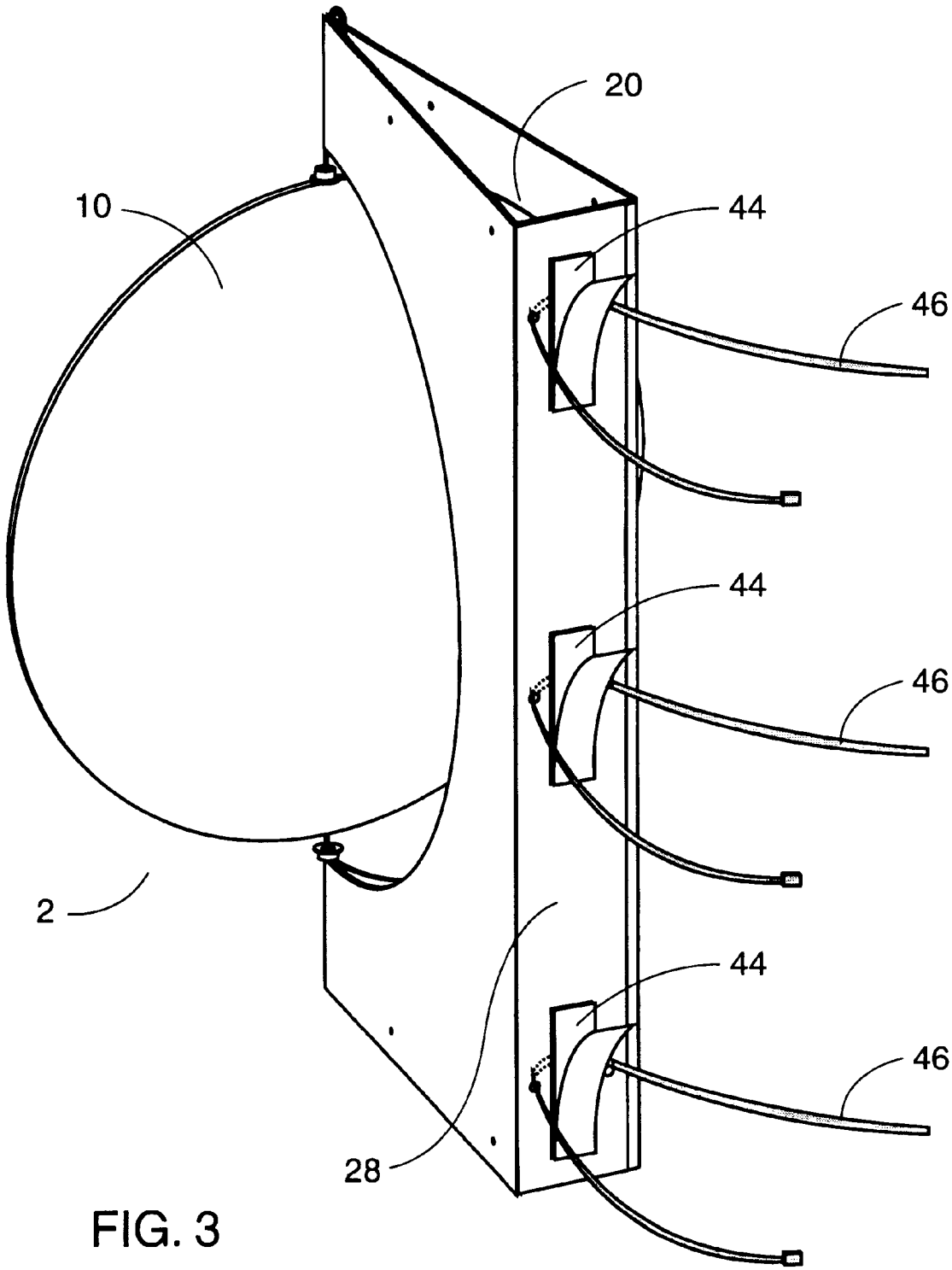
FIG. 3 is a rear view of the sign showing the attachment of mounting straps and showing the temporary adhesive strips located on the rear side of the mounting member.
Figure 4:
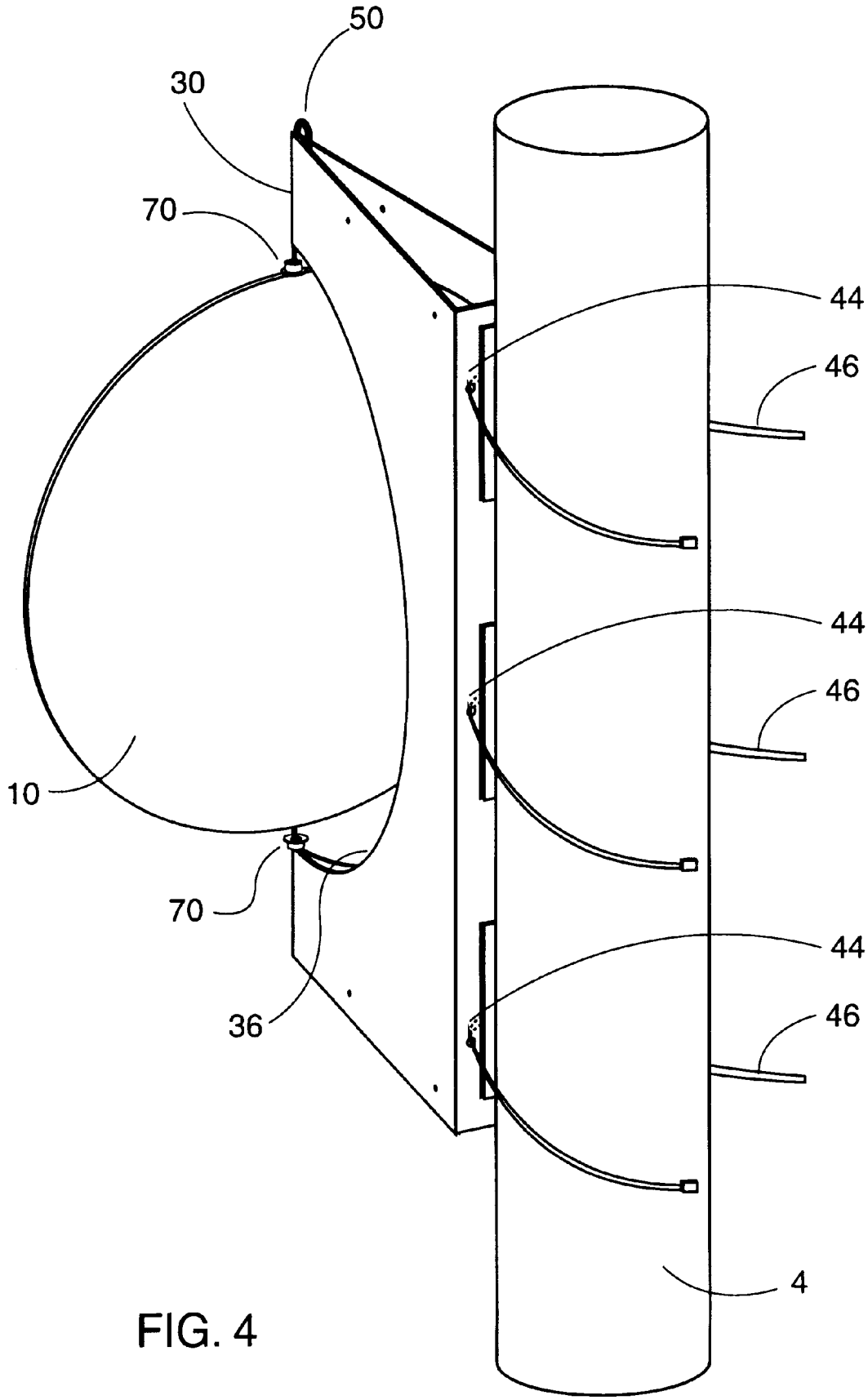
FIG. 4 shows the manner in which the sign is attached or mounted on an pole or post where the disk is free to rotate or oscillate in wind currents of varying strength and direction.
Figure 5:
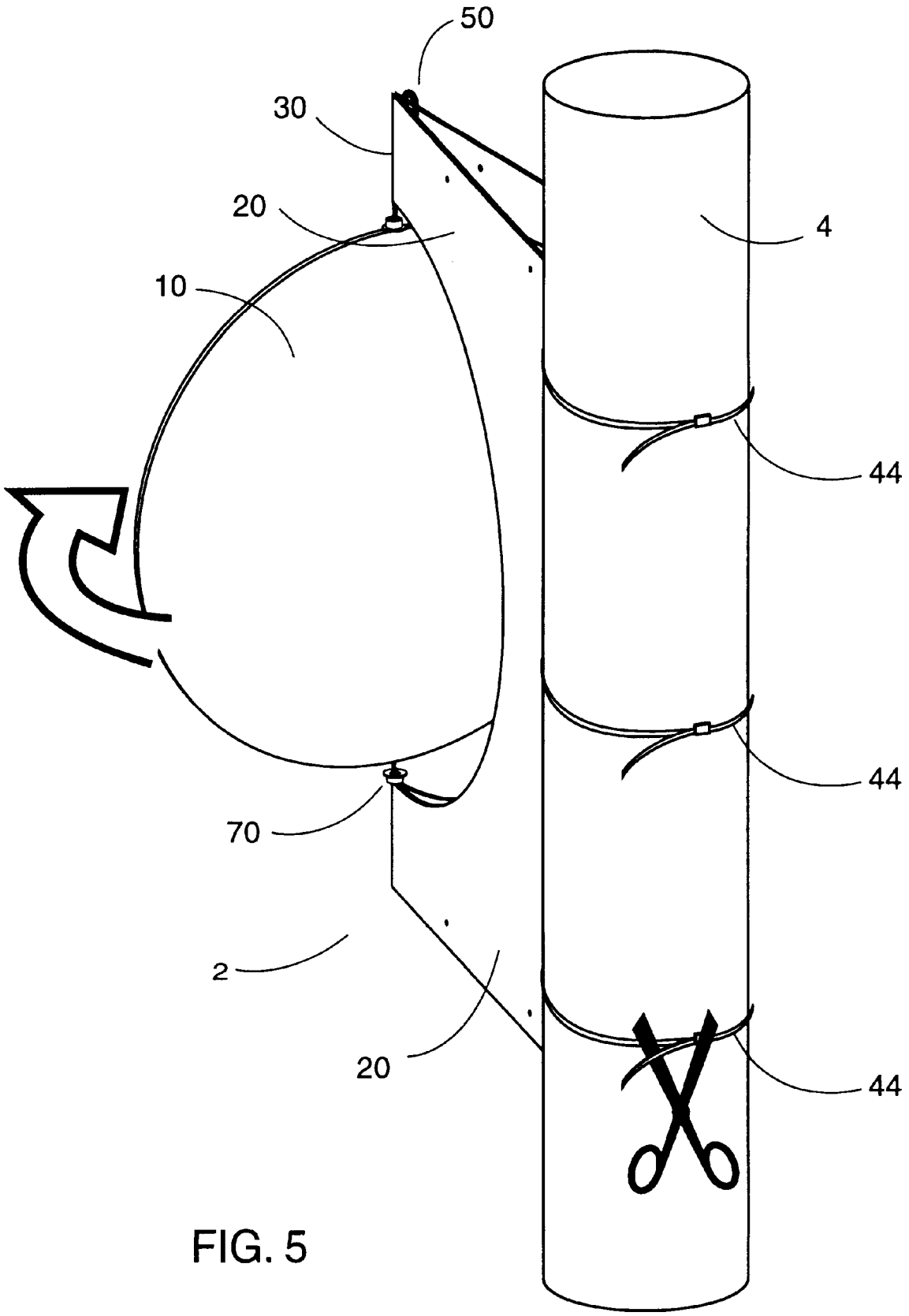
FIG. 5 is a view of the sign mounted on a pole or post.

The movement of the spinning member will depend upon the strength, direction and velocity of the wind currents to which it is exposed. When a flat panel is used, the spinning member will continuously turn in certain situations. In others the flat panel will oscillate, even in a steady wind, through an arc of less than one hundred eighty degrees (180°). This oscillation is perhaps due to the unsteady nature of the airflow across the flat panel, especially as the orientation of the panel to the wind changes as the panel oscillates. The movement of the panel is also affected by the three dimensional nature of the mounting member and of the nearby pole to which the sign is attached. In some conditions the spinning panel will remain oriented in a plane substantially perpendicular to the rear side 26 of the mounting member 20. In this orientation, the side of the spinning disk 10 will bisect the angle formed by the two diverging side panels 22, 24. The semicircular recesses 32 and 34 provide clearance for this portion of the spinning disk. In other wind conditions, the rotatable panel 10 will extend substantially parallel to the rear side 26 as shown in FIGS. 3–5. Note that even a steady wind perpendicular to the disk 10 in this orientation need not cause rotation of the panel 10 because the air pressure on the disk should be substantially the same on both sides of the axis of rotation, thus contributing no turning moment. Regardless of the rotation, oscillation, gyration or other movement of the spinning disk, its movement and its relative orientation will serve to draw attention to the sign and to its message.

A number of equivalent structures for the components have been discussed to demonstrate that the representative embodiment depicted herein is not the only version of this invention that would be apparent to one of ordinary skill in the art. It should also be understood that there are extensions of this invention that would remain within the invention as claimed herein. For example if the movable member is attached to the mounting member on only one end, and if the attachment is articulated, the movable member could move in a complex manner and would not be limited to simple rotation about a fixed axis. Therefore the invention described herein is not limited to the representative embodiment, but is instead defined by the following claims.

We claim:

1. A sign comprising a spinning member secured to a mounting member by an axle, the sign being characterized in that the axle is attached to the mounting member adjacent one end thereof and the axle is attached to the spinning member along an axis of rotation of the spinning member, the mounting member including two diverging sides, for imparting rigidity, with aligned recesses in the two diverging sides configured to provide clearance for the spinning member.

2. The sign of claim 1 wherein the mounting member comprises a folded member with the axle located adjacent a fold between the two diverging sides.

3. The sign of claim 1 wherein the two diverging sides are secured by a third side extending therebetween, the three sides forming the mounting member having a triangular cross section.

4. The sign of claim 3 wherein the third side comprises overlapping sections secured together.

5. The sign of claim 1 wherein the spinning member and the mounting member are each fabricated from flat panels, with the flat panel forming the mounting member being folded to form a support that is more rigid than the flat panel.

6. The sign of claim 1 wherein the spinning member is fabricated from a corrugated flat panel.

7. The sign of claim 6 wherein the axle extend into channels in the corrugated spinning member.

8. The sign of claim 6 wherein the mounting member is fabricated from a corrugated flat panel, wherein the axle extends through aligned channels in the corrugated spinning member and in the corrugated mounting member.

9. The sign of claim 1 wherein the spinning member is fabricated from a lightweight material so that the spinning member is free to spin relative to the mounting member in wind currents.

10. The sign of claim 1 further including at least one spacer secured between diverging panels forming the mounting member to add rigidity to the mounting member.

11. The sign of claim 1 further including a bearing mounted on the axle between the spinning member and the mounting member.

12. The sign of claim 1 wherein the axle comprises a single rod extending completely through the axis of rotation of the spinning member and attached to the mounting member on opposite ends of the spinning member.

13. The sign of claim 1 wherein the spinning member rotates relative to the axle.

14. A lightweight display that can be mounted on a surface including a turning member secured to a mounting member by at least one longitudinal support extending between the mounting member and the turning member, both the mounting member and the turning member being formed by fluted panels, with the longitudinal support being positioned in adjacent flutes in the mounting member and the turning member, so that the turning member is free to move in response to wind currents relative to the mounting member.

15. The lightweight display of claim 14 wherein the turning member is free to rotate through an angle of 360°.

16. The lightweight display of claim 4 wherein the longitudinal support comprises an axle.

17. A placard for displaying visual indicia comprising a first panel and a second panel, the second panel being cut from the first panel to form an opening in the first panel, the first panel being folded to form a three dimensional support member for the second panel with a portion of the opening being located along one side of the three dimensional support member with the second panel being supported partially in the portion of the opening on one side of the support member by at least one rod extending between the support member and the second panel.

18. The placard of claim 17 wherein the first and second panels comprise die cut members.

19. The placard of claim 17 wherein the second panel is free to rotate, vibrate, oscillate, swing or spin depending upon varying strength and direction of wind currents when the placard is placed in an exterior location.

* * * * *